United States Patent [19]

Van Norman

[11] Patent Number: 4,831,505

[45] Date of Patent: May 16, 1989

[54] CIRCULAR FLOURESCENT TUBE LIGHT FIXTURE FOR CEILING FAN

[75] Inventor: Kenneth M. Van Norman, Moline, Ill.

[73] Assignee: Marcia Van Norman, Houston, Tex.

[21] Appl. No.: 106,515

[22] Filed: Oct. 7, 1987

[51] Int. Cl.[4] ..... F21S 5/00

[52] U.S. Cl. ..... 362/216; 362/260; 362/294

[58] Field of Search ..... 362/216, 96, 294, 260

[56] References Cited

U.S. PATENT DOCUMENTS

| | | | |
|---|---|---|---|
| 2,589,760 | 3/1952 | Zelt | 362/216 |
| 4,258,287 | 3/1981 | Hetzel | 362/216 |
| 4,278,911 | 7/1981 | Metoff | 362/216 |
| 4,316,120 | 2/1982 | Cotman et al. | 362/216 |
| 4,327,402 | 4/1987 | Aubrey | 362/216 |
| 4,342,073 | 7/1982 | Ranten | 362/96 |
| 4,685,038 | 8/1987 | Huang | 362/294 |

*Primary Examiner*—Ira S. Lazarus

*Assistant Examiner*—Sue Hagarman

*Attorney, Agent, or Firm*—Robert O. Richardson

[57] ABSTRACT

A circular flourescent tube light fixture for a ceiling fan, particularly one suspended from a low ceiling. The light holder is adjustable upward when a deep concave light reflector is used and is adjustable downward when a flat light shield is used. The holder fits around a tubular housing that mounts on the lower center end of the ceiling fan mechanism. Within this housing is the transformer, starter, and wiring that extends between the ceiling fan motor and the flourescent tube light. A friction spring fits between the light holder and tubular housing to retain the holder in upward position when a deep concave light reflector is used. It also prevents rotation of the holder relative to the housing as an electrical safety measure since electrical wiring extends between them. In one embodiment the light reflector is fastened to the base of the tubular housing and in another it is attached to the holder and moves vertically with the tube light.

8 Claims, 3 Drawing Sheets

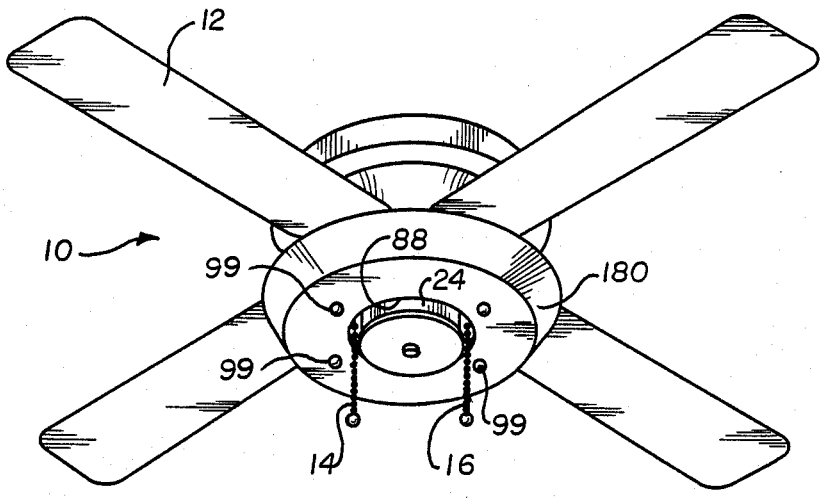
Fig 6
Fig 7
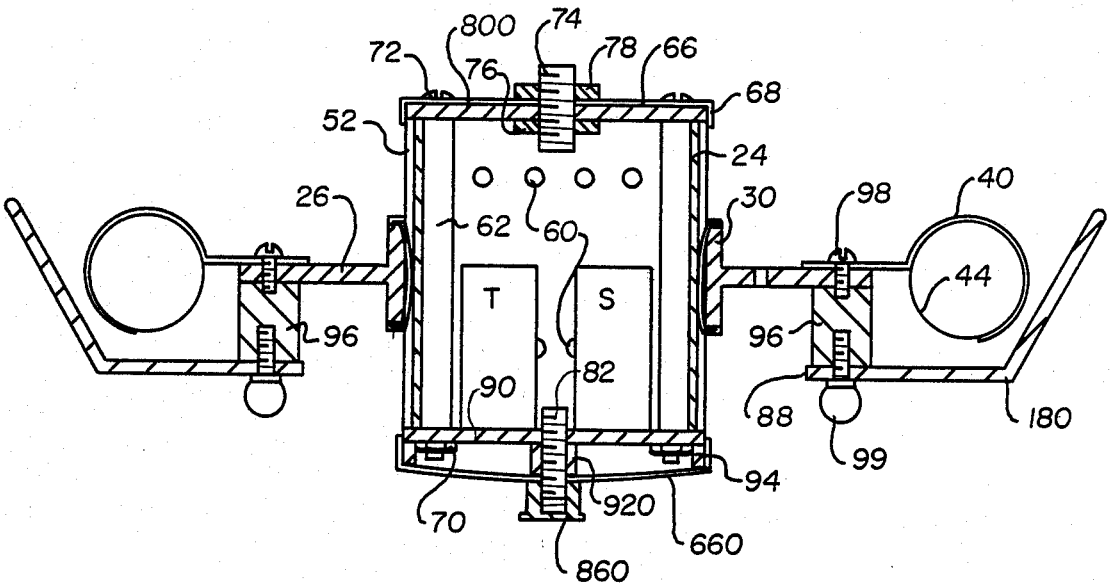

CIRCULAR FLOURESCENT TUBE LIGHT FIXTURE FOR CEILING FAN

BACKGROUND OF THE INVENTION

Ceiling fans are used extensively for cooling or circulating air in rooms of buildings, particularly houses. When higher ceilings permit, a large bulbous light extends down from the ceiling fan central motor mechanism. However, when used where lower ceilings exist, such as in bedrooms and kitchens, the light structure extends downwardly too far to be desirable. The large round reflector bowl has an incadescent light bulb inside that generates heat and is somewhat expensive to operate. A thin flat light such as a circular flourescent tube light with appropriate reflector would be an ideal solution to the problem. However, none appear on the market because of problems that have not heretofore been solved.

SUMMARY OF THE PRESENT INVENTION

In accordance with the present invention a circular flourescent tube light fixture is adapted to fit under a ceiling fan and is designed to fit as close to the ceiling fan as possible. It accommodates both deep concave light reflector shields and flat reflector shields to suit the artistic preference of the user.

Briefly, a circular housing is attached to the base of the ceiling fan. A circular flourescent tube light holder fits around the housing and is adapted to move vertically for adjustment purposes but does not rotate because of a grooved friction spring between the housing and holder. Because there are electrical connections between the housing and holder this is a safety feature. Within the housing is an electrical transformer, starter and wiring between the ceiling fan motor and the flourescent light. A pull chain extends through openings in the light holder and in the reflector shield positioned below the housing.

BRIEF DESCRIPTION OF DRAWINGS

FIG. 6 is a perspective view of another embodiment wherein the light reflector has a central opening to receive the lower end of the housing and to permit the reflector to fit over the housing, and FIG. 7 is a vertical sectional view of the assembly of the second embodiment.

DETAILED DESCRIPTION OF PREFERRED EMBODIMENT

Figure 1:
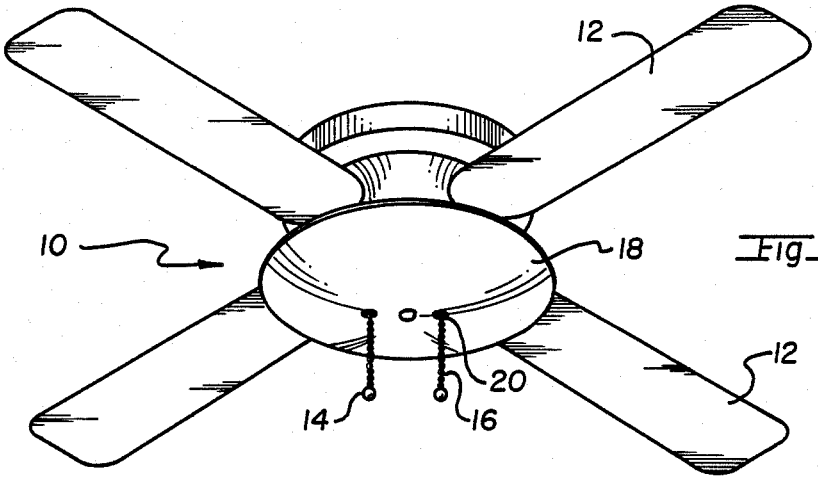
FIG. 1 is a perspective view of an installed ceiling fan with a circular flourescent tube light mounted thereunder shielded by a light reflector with pull chains protruding therethrough.

Reference is made to FIG. 1 wherein there is shown a ceiling fan 10 consisting of a plurality of blades 12, will pull chains 14, 16 to regulate the various forward and reverse speeds of the fan blades. Mounted below the blades a light reflector 18 is shown having openings 20 therein through which the pull chains 14, 16 extend. The light reflector 18 may be either of a flat or deep concave configuration.

Figure 2:
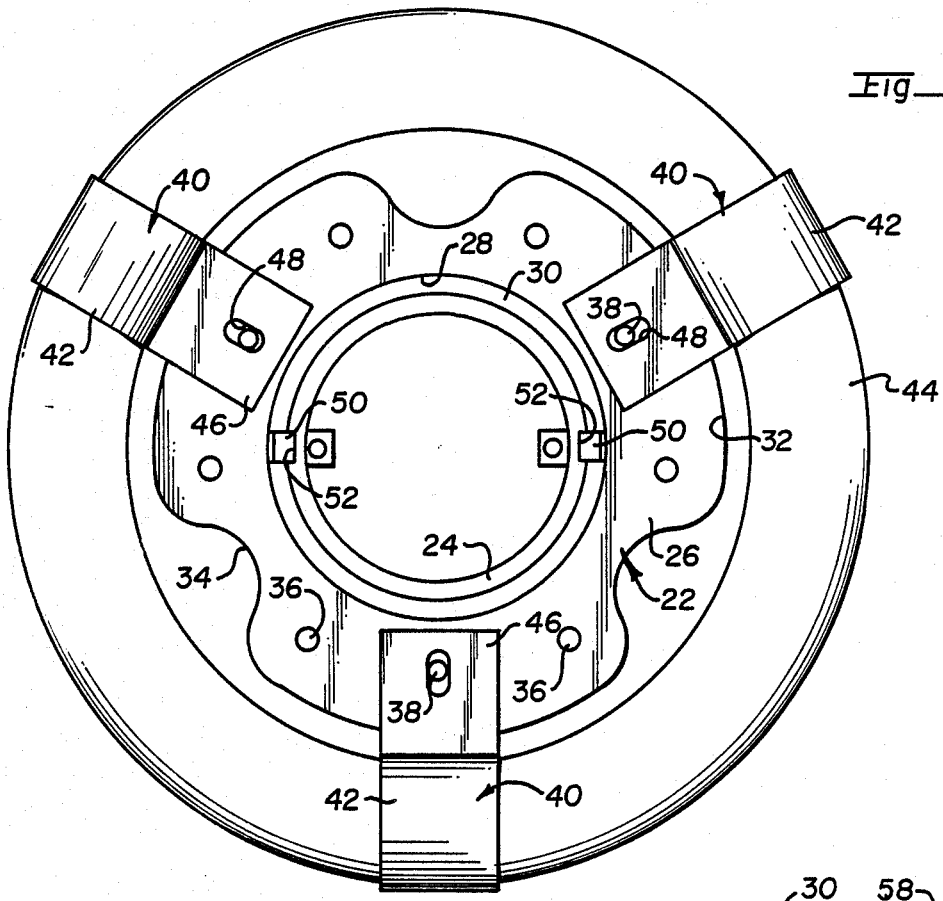
FIG. 2 is a plan view of the light holder positioned over the tubular housing.

FIG. 2 is a plan view of the light holder 22 positioned over tubular housing 24. The holder 22 consists of a clear acrylic plastic plate 26 having a center opening 28 on the order of 3¼ inches in diameter lined with a ¾ inch high collar 30 which is slideable over housing 24. The outer circumference 32 has three finger radius cut out portions 34 whereby the user can move the holder 22 up and down on the housing 24.

Plate 26 has a plurality of apertures 36 through which pull chains 14, 16 in FIG. 1 may be passed in assembly. It also has a plurality of screw holes 38 to which tube holding brackets 40 are attached. These brackets are in the shape similar to that of the letter P. The loop portion 42 fits around the circumference of the flourescent tube 44 and the leg portion 46 rests on the plate 26. It has a slot 48 which is positioned over screw hole 38 for fastening.

Figure 3:
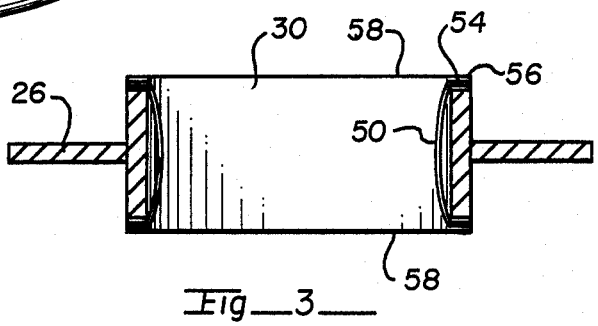
FIG. 3 is a sectional view of the center portion of the holder showing concave springs connected to the collar.

Between collar 30 and housing 24 are concave leaf springs 50 which are fastened to holder collar 30 and ride in vertical grooves 52 on the outer surface of the tubular housing 24 as the tube holder 22 is moved up or down on the housing. As shown in FIG.3 concave leaf springs 50 about 3/16 inches wide, has its ends 54 positioned in notches 56 in the upper and lower edges 58 of collar 30. The midportion of the spring 50 bows inwardly to ride within the vertical groove 52, shown in FIG. 2, about 1/16 inch deep, on the outer surface of housing 24. This provides sufficient friction to keep the holder 22 in its up position on the housing 24 when desired, and prevents inadvertant rotation between the holder and housing.

Figure 4:
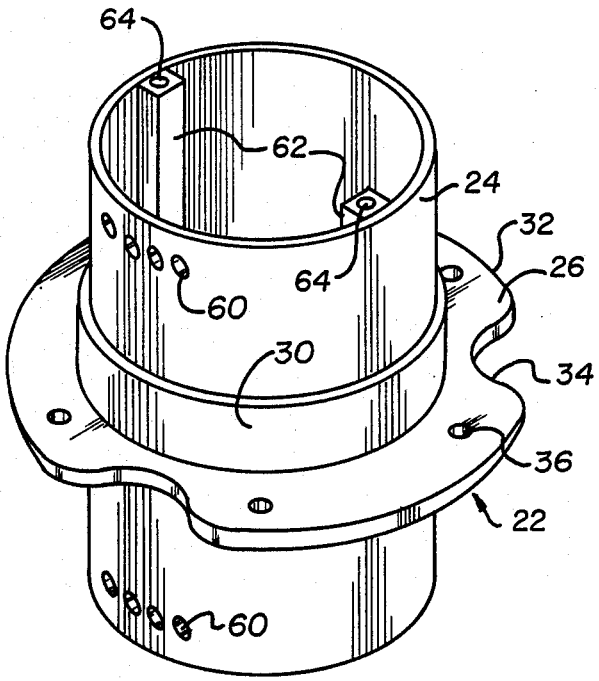
FIG. 4 is a perspective view of the light holder and housing assembly.

FIG. 4 is a perspective view of the light holder and housing assembly. Here can be seen the light holder plate 26 and collar 30 vertically slidable on the outside surface of tubular housing 24. Housing 24 has a plurality of apertures 60 near its top and near its bottom edges. Electric wires may extend through them where needed and the unused ones serve as ventilation for the ceiling fan blades to circulate air on the electrical parts contained within the housing assuring that overheating will not be a problem. On the inside of housing 24 are attached two opposed vertical screw posts 62. Long screws extend through the openings 64 in the posts 62, for mounting purposes as can be seen in FIG. 5.

Figure 5:
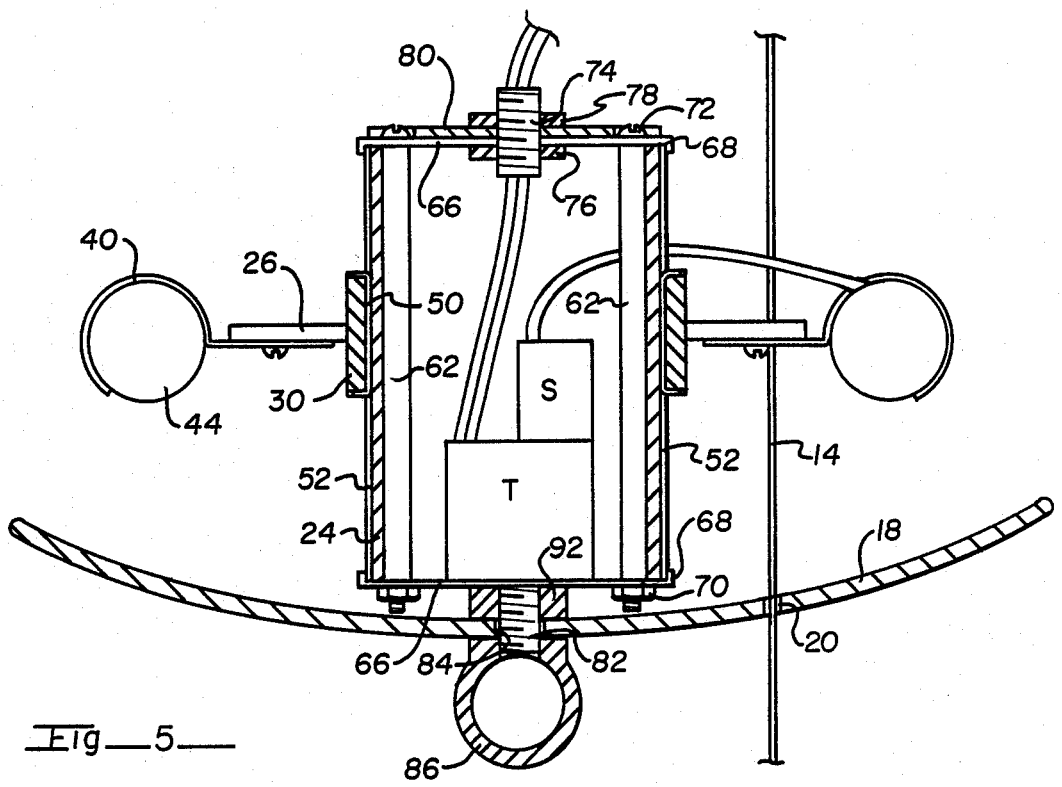
FIG. 5 is a vertical sectional view of the assembly that fits below and onto the ceiling fan.

FIG. 5 is a vertical sectional view of the assembly of the present invention that fits below and onto the ceiling fan. The tube holder collar 30 has a spring 50 that rides in vertical groove 52 as holder plate 26 is moved up or down. Tube holding brackets 40 are fastened to the plate 26 and hold the circular flourescent tube 44. All of these have been previously described in detail. The top and bottom of the tubular housing 24 are covered by open stock lamp cover washers 66 preferably of the type having a rim 68 about the circumference. These may be polished plated brass or stainless white. Typically they have a 3 inch inner diameter and are about .020 inches thick. These washers 66 are held in place by nuts 70 and bolts 72. A threaded stem 74 extends through the center of the top washer 66 and is held in place by nuts 76, 78. A reinforcing plastic disc 80 is placed under the top nut 78 to give the top washer greater rigidity since it must support the rest of the structure below it. The upper part of stem 74 screws into the bottom of the ceiling fan structure above it, not shown in FIG. 5. Within the housing 24 is mounted a transformer T and starter S with appropriate wiring to light the tube 44. Should the starter, with condenser, fail, a cheap replacement is readily available without replacing a more expensive modular unit.

A brass screw 82 is attached to the bottomside of the lower washer 66. To this screw 82 a reflector 18 is inserted through an aperture 84 in its center. A decorative nut 86 holds the reflector in place to complete the assembly.

A second embodiment is shown in FIGS. 6 and 7. Components and parts that are similar to those in the first embodiment in FIGS. 1–5 will have numbers identical to those in the first embodiment, new parts and components will be identified with new numbers, and parts and components that have been modified from those in the first embodiment will have three digits. For example, ceiling fan 10 with blades 12 and pull chains 14, 16 in FIG. 6 is the same as in FIG. 1. Tubular housing 24 is the same. However, the lower lamp cover washer 66 in FIG. 5 is exposed to view in FIGS. 6 and 7, is decorative in appearance and is not held by nuts and bolts around its periphery. Hence, in FIGS. 6 and 7 the lamp cover washer is 660, not 66 as in FIG. 5. The decorative nut 860 in FIGS. 6 and 7 holds the lamp cover washer 660 in position but does not hold the light reflector 180 as does nut 86 in FIG. 5. The light reflector 180 in FIGS. 6 and 7 differs from light reflector 18 in FIGS. 1 and 5 in that it has a central opening 88 so that the reflector 180 is vertically moveable over the tubular housing 24.

With reference to the vertical sectional view in FIG. 7 only the differences from the structure in FIG. 5 need be pointed out. Here the plastic reinforcement disc 800 is below the upper lamp cover washer 660 fits over screw 82 and is held by decorative nut 860. The lower end of housing 24 in FIG. 7 has a bottom disc 90 through which screws 72 extend to receive nuts 70. Central spacer 920 and peripheral spacers 94 space the decorative lamp cover washer 660 from bottom disc 90 in FIG. 7 whereas central spacer 92 in FIG. 5 seats reflector 18 under housing 24.

The major difference between the two embodiments is that the reflector 180 in FIG. 7 moves vertically with light 44 on plate 26 as collar 30 moves on housing 24. This is done by attaching spacer posts 96 under the plate 26 about its outer periphery. These may or may not be aligned with and held by screws 98 whose primary function is to fasten tube holding brackets 40 to plate 26. Decorative screws 99 fasten light reflector 180 to the spacer posts 96. Since the central opening 88 in reflector 180 is outwardly of housing 24, the reflector 180 rides up and down with the plate 26 and light tube 44.

Having knowledge of the foregoing and preferred and illustrative embodiments, it will become obvious to one skilled in the art that alterations and modifications will occur and it is to be understood that such deviations from the foregoing preferred embodiment are to be considered as part of the present invention as set forth in the appended claims.

What is claimed is:

1. A circular flourescent tube light fixture comprising:

a tubular housing having a top and bottom cover, fastening means removably connecting said top and bottom covers with said housing retained therebetween, said housing having a light holder slideably mounted for vertical adjustment on the outer surface thereof, said holder comprising a collar vertically moveable over said housing outer surface, a plate extending radially outwardly from said collar, and tube holding brackets on said plate with a circular flourescent tube light positioned within and held by said brackets.

2. A circular flourescent tube light fixture as set forth in claim 1 wherein a threaded stem is affixed through said upper cover to permit attachment to the bottom of a ceiling fan and for passage of electrical conductors from said fan into said housing.

3. A circular flourescent tube light fixture as set forth in claim 2 wherein a transformer and flourescent light starter components are in said housing and interconnect said tube light to said electrical conductors.

4. A circular flourescent tube light fixture as set forth in claim 1 wherein a screw extends downwardly from said bottom cover, a light reflector having a central aperture therein fits over said screw and is secured thereto with a nut threaded onto said screw.

5. A circular flourescent tube light fixture as set forth in claim 1 wherein said collar has a plurality of leaf springs thereon bearing inwardly against said housing outer surface to frictionally retain said holder in desired vertical position on said housing.

6. A circular flourescent tube light fixture as set forth in claim 5 wherein said leaf springs ride in vertical grooves in said housing outer surface to prevent rotational movement between said housing and said holder.

7. A circular flourescent tube light fixture as set forth in claim 1 wherein a light reflector with a central opening therein is attached to said plate and moves vertically therewith, said reflector fitting around said housing which fits within said central opening of said reflector.

8. A circular flourescent tube light fixture as set forth in claim 1 in combination with a ceiling fan having downwardly extending pull chains, a light reflector attached to said bottom cover, said light reflector having apertures therein through which said pull chains pass.

* * * * *